US007864967B2

(12) United States Patent
Takeuchi et al.

(10) Patent No.: US 7,864,967 B2
(45) Date of Patent: Jan. 4, 2011

(54) SOUND QUALITY CORRECTION APPARATUS, SOUND QUALITY CORRECTION METHOD AND PROGRAM FOR SOUND QUALITY CORRECTION

(75) Inventors: Hirokazu Takeuchi, Machida (JP); Hiroshi Yonekubo, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/576,828

(22) Filed: Oct. 9, 2009

(65) Prior Publication Data

US 2010/0158261 A1 Jun. 24, 2010

(30) Foreign Application Priority Data

Dec. 24, 2008 (JP) ..... 2008-328788

(51) Int. Cl.
*H04R 29/00* (2006.01)
*G10L 11/00* (2006.01)

(52) U.S. Cl. ..... 381/56; 381/110; 704/233

(58) Field of Classification Search ..... 381/56, 381/57, 110; 704/214, 226, 233, 270, 272, 704/278; 84/601–604; 700/94
See application file for complete search history.

(56) References Cited

U.S. PATENT DOCUMENTS 5,298,674 A * 3/1994 Yun ..... 84/616
5,375,188 A 12/1994 Serikawa et al.
5,878,391 A 3/1999 Aarts
7,206,414 B2 * 4/2007 Schulz ..... 381/56
7,232,948 B2 * 6/2007 Zhang ..... 84/600
7,249,015 B2 * 7/2007 Jiang et al. ..... 704/222
7,328,149 B2 * 2/2008 Jiang et al. ..... 704/207
2006/0004568 A1 1/2006 Kondo et al.
2006/0015333 A1 * 1/2006 Gao ..... 704/233
2008/0129862 A1 6/2008 Hamada et al.
2010/0004928 A1 * 1/2010 Yonekubo et al. ..... 704/233

FOREIGN PATENT DOCUMENTS

JP 05-232999 9/1993
JP 07-13586 1/1995
JP 7099651 4/1995
JP 9121355 5/1997

(Continued)

OTHER PUBLICATIONS

Eric Scheirer et al.,"Construction and Evaluation of a Robust Multifeature Speech/Music Discriminator", 1997 IEEE, p. 1331-1334, Interval Research Corp., Palo Alto, CA.

(Continued)

*Primary Examiner*—Xu Mei
(74) *Attorney, Agent, or Firm*—Blakely, Sokoloff, Taylor & Zafman LLP

(57) ABSTRACT

According to one embodiment, various feature parameters are calculated for distinguishing between a speech and music and between music and background sound for an input audio signal. With the feature parameters, score determination is made as to whether the input audio signal is close to a speech signal or a music signal. If the input audio signal is determined to be close to music, the preceding score determination result is corrected considering the influence of background sound. Based on the corrected score value, a sound quality correction process for a speech or music is applied to the input audio signal.

8 Claims, 12 Drawing Sheets

FOREIGN PATENT DOCUMENTS

| | | |
|---|---|---|
| JP | 2004-125944 | 4/2004 |
| JP | 2005-203981 | 7/2005 |
| JP | 2007-004000 | 1/2007 |
| JP | 2008-141546 | 6/2008 |

OTHER PUBLICATIONS

Michael J. Carey et al., "A Comparison of Features for Speech, Music Discrimination", 1999 IEEE, p. 149-152, Ensigma Ltd., Turning House, Monmouthshire, UK.

* cited by examiner

SOUND QUALITY CORRECTION APPARATUS, SOUND QUALITY CORRECTION METHOD AND PROGRAM FOR SOUND QUALITY CORRECTION

CROSS-REFERENCE TO RELATED APPLICATIONS

This application is based upon and claims the benefit of priority from Japanese Patent Application No. 2008-328788, filed Dec. 24, 2008, the entire contents of which are incorporated herein by reference.

BACKGROUND

1. Field

One embodiment of the invention relates to a sound quality correction apparatus, a sound quality correction method and a program for sound quality correction which each adaptively apply a sound quality correction process to a speech signal and a music signal included in an audio (audio frequency) signal to be reproduced.

2. Description of the Related Art

As is well known, for example, in broadcasting receiving devices to receive television broadcasting, information reproducing devices to reproduce recorded information from information recording media, and the like, when an audio signal is reproduced from a received broadcasting signal or a signal read from a information recording medium, a sound quality correction process is applied to the audio signal so as to achieve higher sound quality.

In this case, the content of the sound quality correction process applied to the audio signal differs depending on whether the audio signal is a speech signal, such as a voice, or a music (non-speech) signal, such as a composition. That is, regarding a speech signal, its sound duality is improved by applying a sound quality correction process to it to emphasize its center localization for clarification, as in talk scenes and sport live reports, whereas regarding a music signal, its sound quality is improved by applying a sound quality correction process to it to provide it with expansion with emphasized feeling of stereo.

Therefore, it is being considered to determine whether an acquired audio signal is a speech signal or a music signal and perform the corresponding sound quality correction process depending on the determination result. However, since a speech signal and a music signal are often mixed together in an actual audio signal, distinguishing between the speech signal and the music signal is difficult. Therefore, at present, a suitable sound quality correction process is not applied to an audio signal.

Disclosed in Jpn. Pat. Appln. KOKAI Publication No. 7-13586 is that an acoustic signal is classified into three kinds, "speech", "non-speech" and "undetermined", by analyzing the number of zero-crossing, power variations and the like of the input acoustic signal, and the frequency characteristics for the acoustic signal are controlled such that a characteristic of emphasizing a speech band is kept when the acoustic signal is determined to be "speech", a flat characteristic is kept when the acoustic signal is determined to be "non-speech", and a characteristic of the preceding determination is kept when the acoustic signal is determined to be "undetermined".

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference the accompanying drawings. In general, according to one embodiment of the invention, various feature parameters are calculated for distinguishing between a speech and music and between music and background sound for an input audio signal. With the feature parameters, score determination is made as to whether the input audio signal is close to a speech signal or a music signal. If the input audio signal is determined to be close to music, the preceding score determination result is corrected considering the influence of background sound. Based on the corrected score value, a sound quality correction process for a speech or music is applied to the input audio signal.

Figure 1:
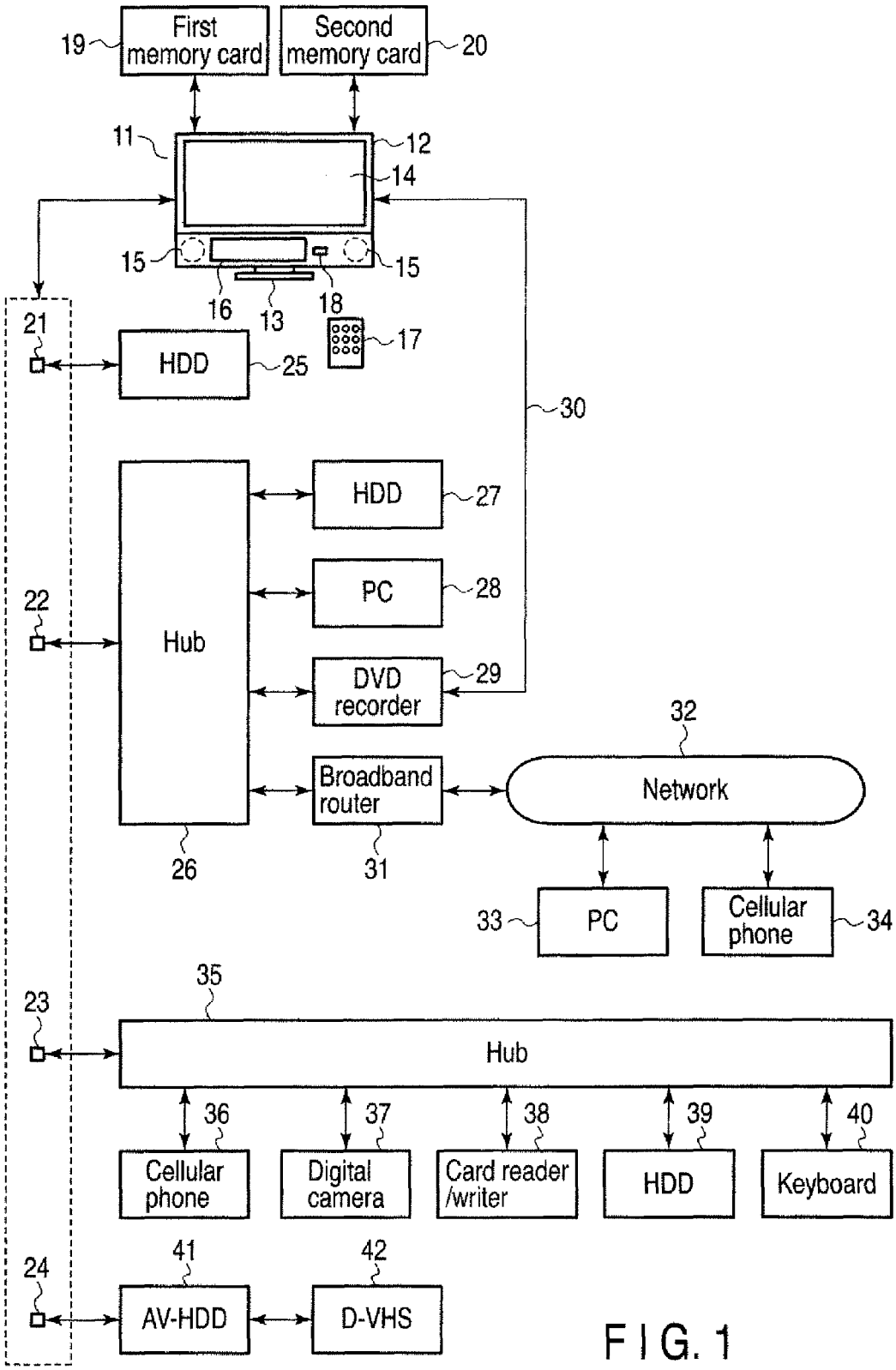
FIG. 1 shows an embodiment of the invention for schematically explaining an example of a digital television broadcasting receiving apparatus and a network system centering thereon.

FIG. 1 schematically shows the appearance of a digital television broadcasting receiving apparatus 11 to be described in this embodiment and an example of a network system configured centering on the digital television broadcasting receiving apparatus 11.

That is, the digital television broadcasting receiving apparatus 11 mainly includes a thin cabinet 12 and a support table 13 to support the cabinet 12 standing upright. Installed in the cabinet 12 are a flat panel video display 14, for example, of an SED (surface-conduction electron-emitter display) panel or a liquid crystal display panel, a pair of speakers 15, an operation module 16, a light receiving module 18 to receive operation information sent from a remote controller 17, and the like.

A first memory card 19, such as an SD (secure digital) memory card, an MMC (multimedia card) or a memory stick, can be attached to and detached from the digital television broadcasting receiving apparatus 11. Information, such as programs and photographs, is recorded on and reproduced from the first memory card 19.

Further, a second memory card (IC (integrated circuit) card or the like) 20 on which contract information and the like are recorded can be attached to and detached from the digital television broadcasting receiving apparatus 11, so that information can be recorded on and reproduced from the second memory card 20.

The digital television broadcasting receiving apparatus 11 also includes a first LAN (local area network) terminal 21, a second LAN terminal 22, a USB (universal serial bus) terminal 23 and an IEEE (institute of electrical and electronics engineers) 1394 terminal 24.

Among the above terminals, the first LAN terminal 21 is used as a port for exclusive use with a LAN-capable HDD (hard disk drive). That is, the first LAN terminal 21 is used for recording and reproducing information on and from the LAN-capable HDD 25, which is connected thereto and serves as an NAS (network attached storage), through Ethernet (registered trademark).

Thus, the first LAN terminal 21 is provided as a port for exclusive use with a LAN-capable HDD in the digital television broadcasting receiving apparatus 11. This allows information of broadcasting programs of high definition television quality to be stably recorded on the HOD 25 without being influenced by other network environments and network usage.

The second LAN terminal 22 is used as a general LAN-capable port using Ethernet (registered trademark). That is, the second LAN terminal 22 is used to connect devices, such as a LAN-capable HDD 27, a PC (personal computer) 28, and a DVD (digital versatile disk) recorder 29 with a built-in HDD, through a hub 26, for example, for building a home network and to transmit information from and to these devices.

In this case, the PC 28 and the DVD recorder 29 are each configured as a UPnP (universal plug and play)-capable device which has functions for operating as a server device of contents in the home network and further includes a service for providing URI (uniform resource identifier) information required for access to the contents.

Note that for the DVD recorder 29, an analog channel 30 for its exclusive use is provided for transmitting analog image and audio information to and from the digital television broadcasting receiving apparatus 11, since digital information communicated through the second LAN terminal 22 is only information on the control system.

Further, the second LAN terminal 22 is connected to an external network 32, such as the Internet, through a broadband router 31 connected to the hub 26. The second LAN terminal 22 is also used for transmitting information to and from a PC 33, a cellular phone 34 and the like through the network 32.

The USB terminal 23 is used as a general USB-capable port, and is used, for example, for connecting USB devices, such as a cellular phone 36, a digital camera 37, a card reader/writer 38 for memory cards, an HDD 39 and a keyboard 40, and transmitting information to and from these USB devices, through a hub 35.

Further, the IEEE1394 terminal 24 is used for establishing a serial connection of a plurality of information recording and reproducing devices, such as an AV (audio visual)-HDD 41 and a D (digital)-VHS (video home system) 42, and selectively transmitting information to and from each device.

Figure 2:
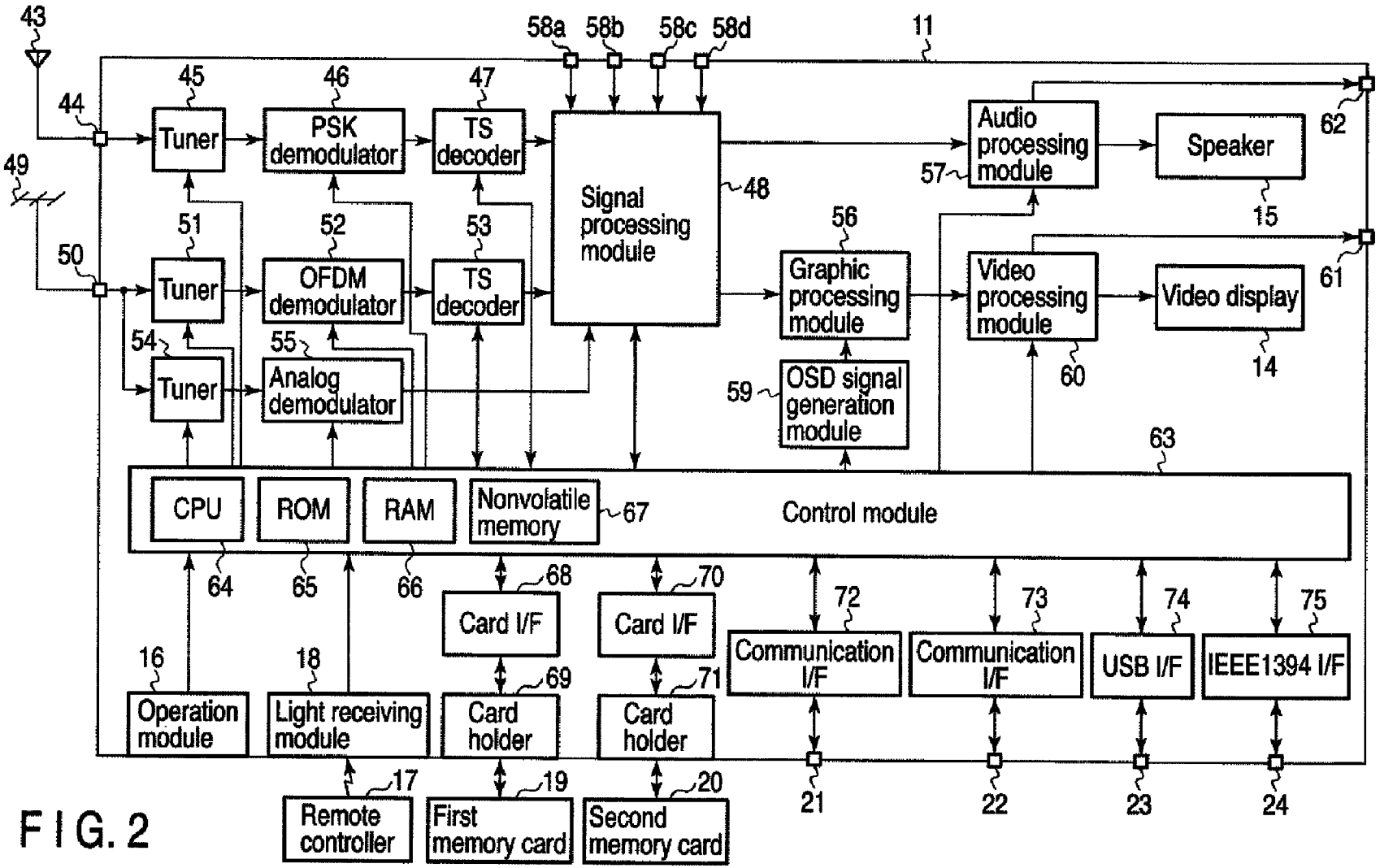
FIG. 2 is a block diagram showing a main signal processing system of the digital television broadcasting receiving apparatus in the embodiment.

FIG. 2 shows the main signal processing system of the digital television broadcasting receiving apparatus 11. That is, a satellite digital television broadcasting signal received by a BS/CS (broadcasting satellite/communication satellite) digital broadcasting receiving antenna 43 is supplied through an input terminal 44 to a satellite digital broadcasting tuner 45, thereby selecting a broadcasting signal of a desired channel.

The broadcasting signal selected by the tuner 45 is sequentially supplied to a PSK (phase shift keying) demodulator 46 and a TS (transport stream) decoder 47 and is demodulated into digital video and audio signals, which are then output to a signal processing module 48.

A terrestrial digital television broadcasting signal received by a terrestrial broadcasting receiving antenna 49 is supplied through an input terminal 50 to a terrestrial digital broadcasting tuner 51, thereby selecting a broadcasting signal of a desired channel.

The broadcasting signal selected by the tuner 51 is sequentially supplied, for example, to an OFDM (orthogonal frequency division multiplexing) demodulator 52 and a TS decoder 53 in Japan and is demodulated into digital video and audio signals, which are then output to the signal processing module 48.

A terrestrial analog television broadcasting signal received by the terrestrial broadcasting receiving antenna 49 is supplied through the input terminal 50 to a terrestrial analog broadcasting tuner 54, thereby selecting a broadcasting signal of a desired channel. The broadcasting signal selected by the tuner 54 is supplied to an analog demodulator 55 and is demodulated into analog video and audio signals, which are then output to the signal processing module 48.

The signal processing module 48 selectively applies a predetermined digital signal process to digital video and audio signals supplied from the TS decoders 47 and 53, and outputs the signals to a graphic processing module 56 and an audio processing module 57.

Connected to the signal processing module 48 are a plurality of (four in the case shown in the drawing) input terminals 58*a*, 58*b*, 58*c* and 58*d*. The input terminals 58*a* to 58*d* each allow analog video and audio signals to be input from the outside of the digital television broadcasting receiving apparatus 11.

The signal processing module 48 selectively digitalizes analog video and audio signals supplied from each of the analog demodulator 55 and the input terminals 58*a* to 58*d*, and applies a predetermined digital signal process to the digitalized video and audio signals, and then outputs the signals to a graphic processing module 56 and an audio processing module 57.

The graphic processing module 56 has a function to superimpose an OSD (on screen display) signal generated in an OSD signal generation module 59 on the digital video signal supplied form the signal processing module 48 and output them. The graphic processing module 56 can selectively output the output video signal of the signal processing module 48 and the output OSD signal of the OSD signal generation module 59, and can also output both the output signals in combination such that each output forms half of a screen.

The digital video signal output from the graphic processing module 56 is supplied to a video processing module 60. The video processing module 60 converts the input digital video signal into an analog video signal in a format which allows the signal to be displayed on the video display 14, and then outputs the resultant signal to the video display 14 for video displaying and also draws the resultant signal through an output terminal 61 to the outside.

The audio processing module 57 applies a sound quality correction process to be described later to the input digital audio signal, and then converts the signal into an analog audio signal in a format which allows the signal to be reproduced by the speaker 15. The analog audio signal is output by the speaker 15 for audio reproducing and is also drawn to the outside through an output terminal 62.

In the digital television broadcasting receiving apparatus 11, all of the operation including the above-mentioned various kinds of receiving operation is centrally controlled by a control module 63. The control module 63, which has a CPU (central processing unit) 64 built therein, receives operation information from the operation module 16 or operation information sent from the remote controller 17 and received by the light receiving module 18, and controls each module so as to reflect the operation content.

In this case, the control module 63 mainly uses a ROM (read only memory) 65 in which a control program to be executed by the CPU 64 is stored, a RAM (random access memory) 66 which provides an working area for the CPU 64, and a nonvolatile memory 67 in which various setting information and control information are stored.

The control module 63 is connected through a card I/F (interface) 68 to a card holder 69 to which the first memory card 19 can be attached. This allows the control module 63 to transmit information through the card I/F 68 to and from the first memory card 19 attached to the card holder 69.

Further, the control module 63 is connected through a card I/F (interface) 70 to a card holder 71 to which the second memory card 20 can be attached. This allows the control module 63 to transmit information through the card I/F 70 to and from the second memory card 20 attached to the card holder 71.

The control module 63 is connected through a communication I/F 72 to the first LAN terminal 21. This allows the control module 63 to transmit information through the card I/F 72 to and from the LAN-capable HDD 25 connected to the first LAN terminal 21. In this case, the control module 63 has a DHCP (dynamic host configuration protocol) server function, and assigns an IP (internet protocol) address to the LAN-capable HDD 25 connected to the first LAN terminal 21 for controlling.

Further, the control module 63 is connected through a communication I/F 73 to the second LAN terminal 22. This allows the control module 63 to transmit information through the card I/F 73 to and from each device (see FIG. 1) connected to the second LAN terminal 22.

The control module 63 is connected through a USB I/F 74 to the USB terminal 23. This allows the control module 63 to transmit information through the USB I/F 74 to and from each device (see FIG. 1) connected to the USB terminal 23.

Further, the control module 63 is connected through an IEEE1394 I/F 75 to the IEEE1394 terminal 24. This allows the control module 63 to transmit information through the IEEE1394 I/F 75 to and from each device (see FIG. 1) connected to the IEEE1394 terminal 24.

Figure 3:
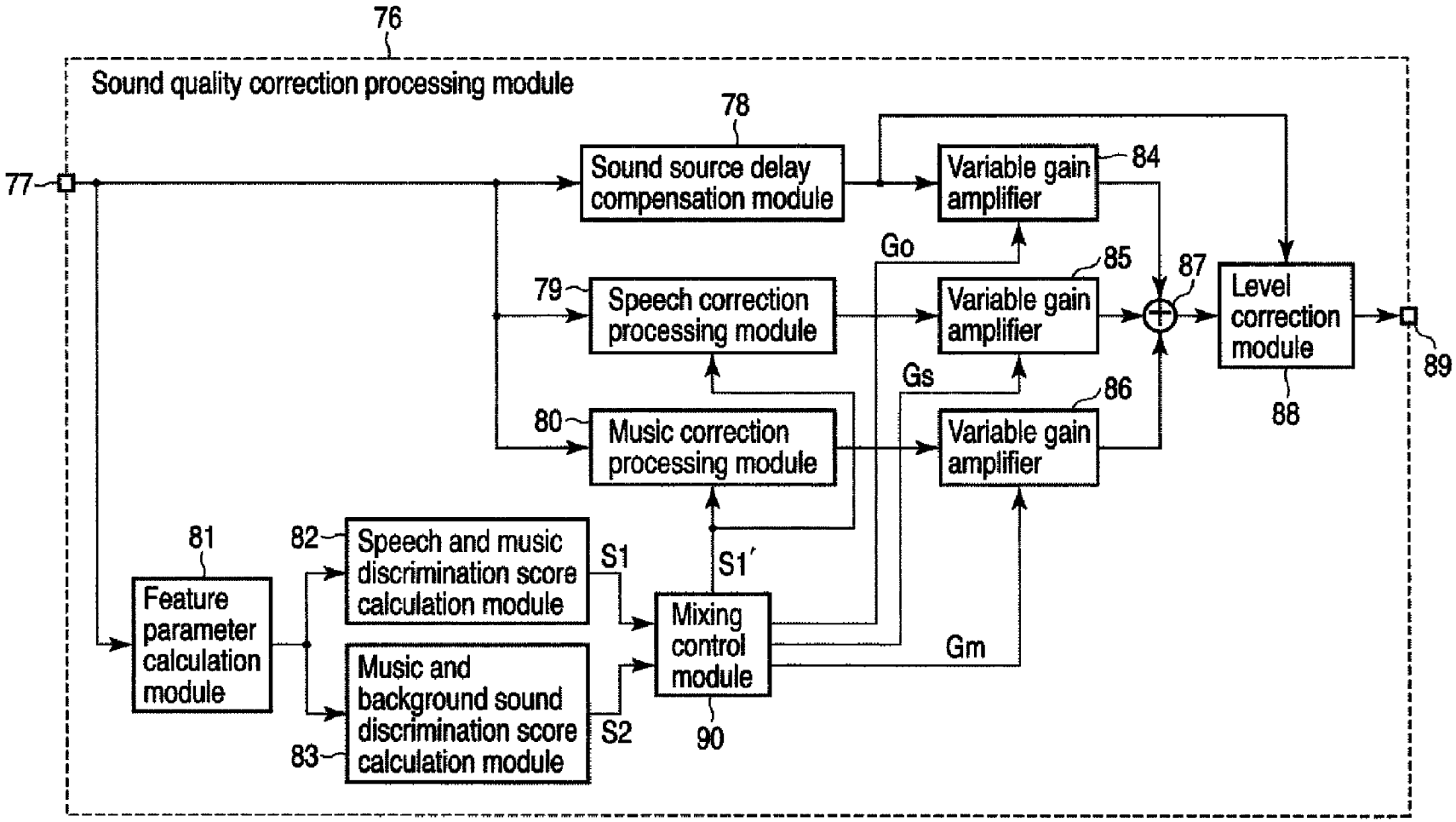
FIG. 3 is a block diagram showing a sound quality correction processing module included in an audio processing module of the digital television broadcasting receiving apparatus in the embodiment.

FIG. 3 shows a sound quality correction processing module 76 provided in the audio processing module 57. In the sound quality correction processing module 76, an audio signal supplied to an input terminal 77 is supplied to each of a sound source delay compensation module 78, a speech correction processing module 79 and a music correction processing module 80, and is also supplied to a feature parameter calculation module 81.

Among these modules, the feature parameter calculation module 81 calculates various feature parameters for distinguishing between a speech signal and music signal for an input audio signal, and various feature parameters for distinguishing between a music signal and a background sound signal to constitute background sound, such as BGM (back ground music), claps and cheers.

Figure 4:
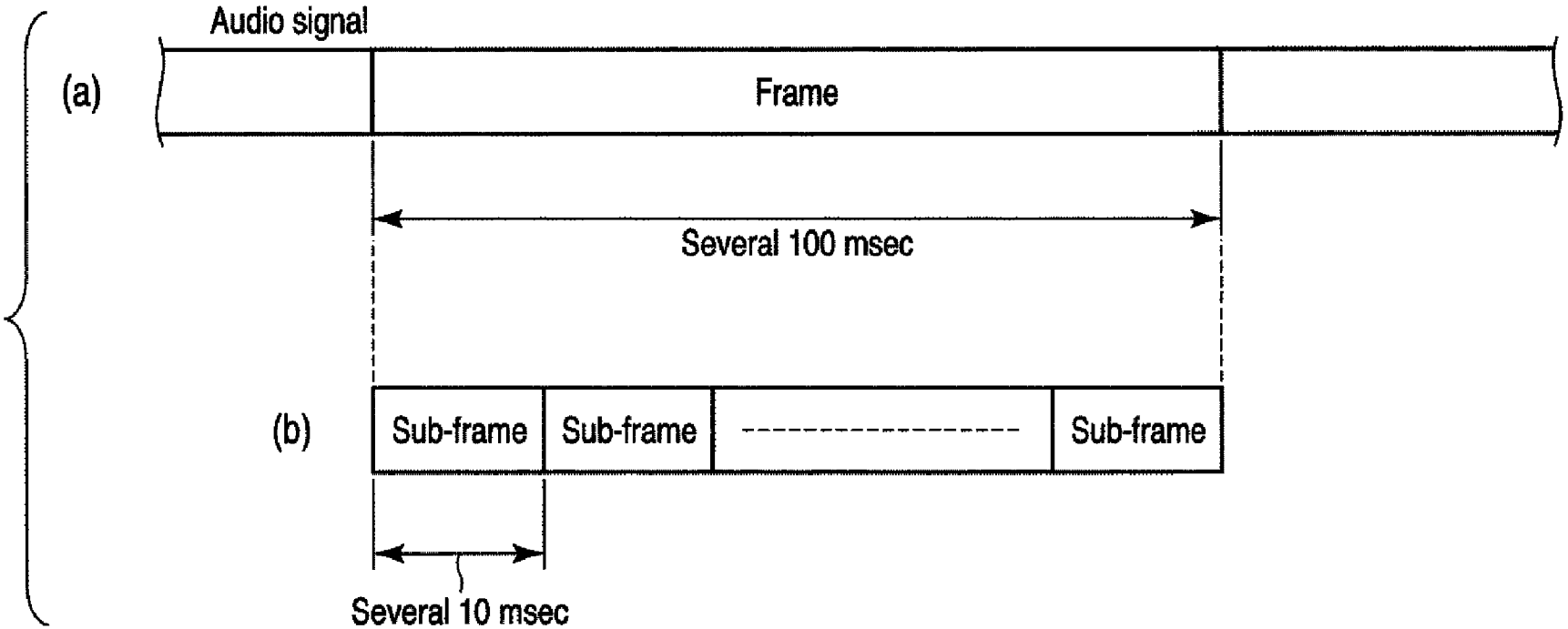
FIG. 4 shows the operation of a feature parameter calculation module included in the sound quality correction processing module in the embodiment.

That is, the feature parameter calculation module 81 cuts the input audio signal into frames of about several hundred milliseconds, and further each frame is divided into sub-frames of about several tens of milliseconds, as indicated by mark (a) of FIG. 4.

In this case, the feature parameter calculation module 81 calculates various kinds of distinguishing information for distinguishing between a speech signal and a music signal for an input audio signal, and various kinds of distinguishing information for distinguishing between a music signal and a background sound signal, on a sub-frame-by-sub-frame basis. For each of the calculated various kinds of distinguishing information, statistics (e.g., average, variance, maximum, minimum) on a frame-by-frame basis are obtained. Thus, various feature parameters are generated.

For example, in the feature parameter calculation module 81, a power value, which is the sum of squares of the amplitude of an input audio signal, is calculated on the sub-frame-by-sub-frame basis as distinguishing information, and the statistics on the frame-by-frame basis for the calculated power value are obtained. Thus, a feature parameter pw for the power value is generated.

Also, in the feature parameter calculation module 81, a zero-crossing frequency, which is the number of times the time waveform of an input audio signal crosses zero in the amplitude direction, is calculated on the sub-frame-by-sub-frame basis as distinguishing information, and the statistics on the frame-by-frame basis for the calculated zero-crossing frequency are obtained. Thus, a feature parameter zc for the zero-crossing frequency is generated.

Further, in the feature parameter calculation module 81, spectral fluctuations in the frequency domain of an input audio signal are calculated on the sub-frame-by-sub-frame basis as distinguishing information, and the statistics on the frame-by-frame basis for the calculated spectral fluctuations are obtained. Thus, a feature parameter sf for the spectral fluctuations is generated.

Also, in the feature parameter calculation module 81, the power rate of left and right (LR) signals of the 2-channel stereo signal (LR power rate) in an input audio signal is calculated on the sub-frame-by-sub-frame basis as distinguishing information, and the statistics on the frame-by-frame basis for the calculated LR power rate are obtained. Thus, a feature parameter lr for the LR power rate is generated.

Further, in the feature parameter calculation module 81, after changing an input audio signal into a frequency domain, the concentration rate of the power component in a specific frequency band which is characteristic of the musical instrument tone of a composition is calculated on the sub-frame-by-sub-frame basis as distinguishing information. The concentration rate is represented as a power occupancy rate and so on in the characteristic, specific frequency band in the whole band or a specific band of the input audio signal. In the feature parameter calculation module 81, the statistics on the frame-by-frame basis for the distinguishing information are obtained, thereby generating a feature parameter inst for the specific frequency band characteristic of the musical instrument tone.

Figure 5:
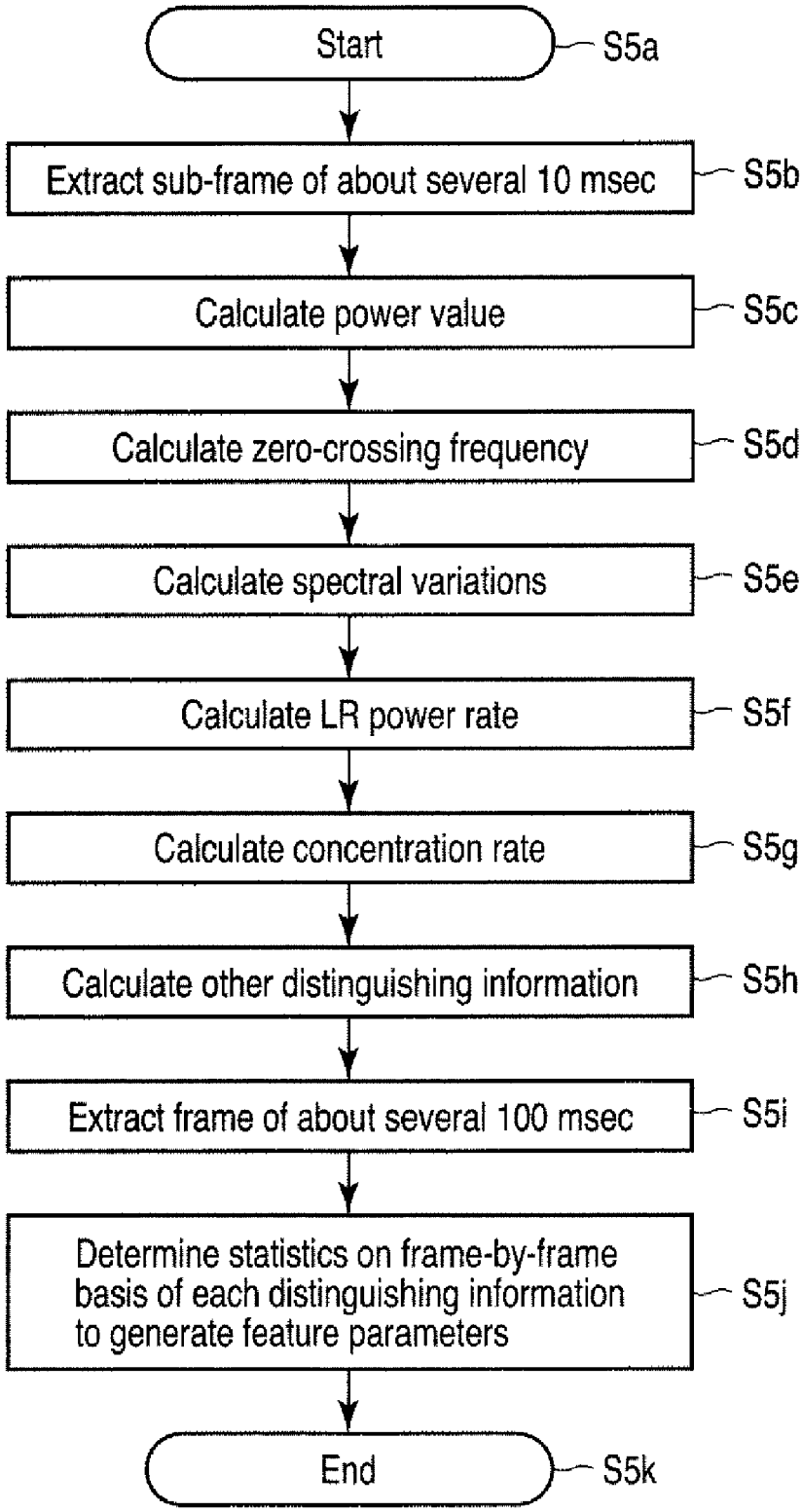
FIG. 5 is a flowchart showing the processing operation performed by the feature parameter calculation module in the embodiment.

FIG. 5 is an exemplary flowchart which works out various kinds of processing operation for the feature parameter calculation module 81 to generate various feature parameters for distinguishing between a speech signal and a music signal for an input audio signal and various feature parameters for distinguishing between a music signal and a background sound signal.

That is, when the process starts (step S5*a*), the feature parameter calculation module 81 extracts a sub-frame of about several tens of milliseconds from an input audio signal in step S5*b*. The feature parameter calculation module 81 calculates a power value on a sub-frame-by-sub-frame basis from the input audio signal in step S5*c*.

Then, the feature parameter calculation module 81 calculates a zero-crossing frequency on the sub-frame-by-sub-frame basis from the input audio signal in step S5*d*, calculates spectral fluctuations on the sub-frame-by-sub-frame basis from the input audio signal in step S5*e*, and calculates an LR power rate on the sub-frame-by-sub-frame basis from the input audio signal in step S5*f*.

The feature parameter calculation module 81 calculates the concentration rate of the power component of a specific frequency band which is characteristic of the musical instrument tone, on the sub-frame-by-sub-frame basis, from the input audio signal in step S5*g*. Similarly, the feature parameter calculation module 81 calculates other distinguishing information on the sub-frame-by-sub-frame basis from the input audio signal in step S5*h*.

Then, the feature parameter calculation module 81 extracts a frame of about several hundred milliseconds from the input audio signal in step S5*i*. The feature parameter calculation module 81 determines statistics on the frame-by-frame basis for each of various kinds of distinguishing information calculated on the sub-frame-by-sub-frame basis to generate various feature parameters in step S5*j*, and the process ends (step S5*k*).

As described above, various feature parameters generated in the feature parameter calculation module 81 are each supplied to a speech and music discrimination score calculation module 82 and a music and background sound discrimination score calculation module 83.

Of the modules, the speech and music discrimination score calculation module 82 calculates a speech and music discrimination score S1 which quantitatively represents whether an audio signal supplied to the input terminal 77 is close to the characteristic of a speech signal, such as a speech, or the characteristic of a music (composition) signal, based on various feature parameters generated in the feature parameter calculation module 81, the details of which will be described later.

The music and background sound discrimination score calculation module 83 calculates a music and background sound discrimination score S2 which quantitatively represents whether the audio signal supplied to the input terminal 77 is close to the characteristic of a music signal or the characteristic of a background sound signal, based on various feature parameters generated in the feature parameter calculation module 81, the details of which will be described later.

On the other hand, the speech correction processing module 79 performs a sound quality correction process so as to emphasize a speech signal in the input audio signal. For example, speech signals in a sport live report and a talk scene in a music program are emphasized for clarification. Most of these speech signals are localized at the center in the case of stereo, and therefore sound quality correction for the speech signals is enabled by emphasizing the signal components at the center.

The music correction processing module 80 applies a sound quality correction process to a music signal in the input audio signal. For example, a wide stereo process or a reverberate process is performed for music signals in a composition performance scene in a music program to accomplish a sound field with spreading feeling.

Further, the sound source delay compensation module 78 is provided to absorb processing delays between a sound source signal, which is unchanged from the input audio signal, and a speech signal and a music signal obtained from the speech correction processing module 79 and the music correction processing module 80. This allows an allophone associated with a time lag of signals to be prevented from occurring upon mixing (or upon switching) of the sound source signal, the speech signal and the music signal in the latter part.

The sound source signal, the speech signal and the music signal output from the sound source delay compensation module 78, the speech correction processing module 79 and the music correction processing module 80 are supplied to variable gain amplifiers 84, 85 and 86, respectively, and are each amplified with a predetermined gain and then mixed by an adder 87. In this way, an audio signal obtained by adaptively applying sound quality correction processes to the sound source signal, the speech signal and the music signal using gain adjustment is generated.

Then, the audio signal output from the adder 87 is supplied to a level correction module 88. The level correction module 88 applies level correction to the input audio signal, based on the sound source signal supplied from the sound source delay compensation module 78, so that the level of the output audio signal is settled within a range of a certain level with respect to the sound source signal.

In the level correction, the levels of a speech signal and a music signal may be varied by correction processes of the speech correction processing module 79 and the music correction processing module 80. Mixing the sound source signal with the speech signal and the music signal having levels varied in this way prevents the level of the output audio signal from varying. This also prevents a listener from being given uncomfortable feeling.

Specifically speaking, in the level correction module 88, the power of sound source signals equivalent to the last several tens of frames is calculated. Using the calculated power as the base, when the level of the audio signal after mixing by the adder 87 exceeds a certain level as compared to the level of the sound source signal, gain adjustment is performed so that the output audio signal is equal to or less than the certain level, thus performing level correction. Then, the audio signal to which the level correction process is applied by the level correction module 88 is supplied through an output terminal 89 to the speaker 15 for audio reproducing.

The speech and music discrimination score S1 output from the speech and music discrimination score calculation module 82 and the music and background sound discrimination score S2 output from the music and background sound discrimination score calculation module 83 are supplied to a mixing control module 90. The mixing control module 90 generates a determination score S1' for controlling the presence or absence of a correction process and the extent of the correction process in the speech correction processing module 79 and the music correction processing module 80, based on the input speech and music discrimination score S1 and the music and background sound discrimination score S2, the details of which will be described later.

The mixing control module 90 also sets gains Go, Gs and Gm to be provided to the variable gain amplifiers 84, 85 and 86 in accordance with the determination score S1' generated based on the input speech and music discrimination score S1 and the music and background sound discrimination score S2. This enables the optimum sound quality correction process by gain adjustment to be applied to the sound source signal, the speech signal and the music signal output from the sound source delay compensation module 78, the speech correction processing module 79 and the music correction processing module 80.

Next, prior to description on calculations of the speech and music discrimination score S1 and the music and background sound discrimination score S2, description is given on the properties of various feature parameters. First, the feature parameter pw on the power value is described. Regarding power variations, in general, since sections of utterance and sections of silence alternately appear in a speech, differences in signal power among sub-frames tend to be large. When seen on a frame-by-frame basis, variance of power values among sub-frames tends to be large. The term "power variations" as used herein refers to a feature quantity focusing on value variations in a longer frame section for the power value calculated in a sub-frame. Specifically, variance of power values and so on are used.

The feature parameter zc on the zero-crossing frequency is described. Regarding the zero-crossing frequency, in addition to the differences between the utterance sections and the silence sections described above, the zero-crossing frequency is high in consonants and low in vowels for a speech signal. When seen on a frame-by-frame basis, variance of the zero-crossing frequency among sub-frames tends to be large.

Further, the feature parameter sf on the spectral fluctuations is described. Regarding the spectral fluctuations, since variations in frequency characteristics of a speech signal is sharp as compared to those of a tonal (tone structural) signal, such as a music signal, variance of spectral fluctuations tends to be large on a frame-by-frame basis.

The feature parameter lr on the LR power rate is described. Regarding the LR power rate, musical instrument performances other than vocal are often localized at positions other than the center in music signals. The power rate of right and left channels therefore tends to be large.

In the speech and music discrimination score calculation module 82, the speech and music discrimination score S1 is calculated using feature parameters, which focus on differences in properties between a speech signal and a music signal and with which those signal types are easily divided, like the feature parameters pw, zc, sf and lr.

However, the feature parameters pw, zc, sf and lr are effective for distinguishing between a pure speech signal and a pure music signal, but do not necessarily have the same distinguishing effects for a speech signal on which background sound is superimposed, such as a large number of claps, cheers and sounds of laughter. In this case, erroneous determination that the speech signal is a music signal is likely to occur because of the effects of background sound.

To suppress such erroneous determination, in the music and background sound discrimination score calculation module 83, the music and background sound discrimination score S2, which quantitatively represents whether the input audio signal is close to the characteristic of a music signal or the characteristic of a background sound signal, is calculated. In the mixing control module 90, based on the music and background sound discrimination score S2, the speech and music discrimination score S1 is corrected. Thus, the final determination score S1' to be provided to the speech correction processing module 79 and the music correction processing module 80 is generated.

In this case, in the music and background sound discrimination score calculation module 83, the feature parameter inst corresponding to the concentration rate of a specific frequency component of a music instrument is employed as distinguishing information suitable for distinguishing between a music signal and a background sound signal.

The feature parameter inst is described. Regarding a music signal, amplitude power is often concentrated on a specific frequency band because of a musical instrument used for a composition. For example, in many current compositions, a musical instrument functioning as the base exists. When the base sound is analyzed, the amplitude power is concentrated on a specific low frequency band in the frequency domain of the signal.

In contrast, such power concentration on a specific low frequency band is not found in a background sound signal. The feature parameter inst functions as an effective index for distinguishing between a music signal and a background sound signal.

Next, description is given on the calculation of the speech and music discrimination score S1 and the music and background sound discrimination score S2 in the speech and music discrimination score calculation module 82 and the music and background sound discrimination score calculation module 83. The calculation method of the speech and music discrimination score S1 and the music and background sound discrimination score S2 is not limited to one method. Here, a calculation method using a linear discriminant function is described.

In the method using a linear discriminant function, a weighting factor for multiplying various feature parameters required for calculation of the speech and music discrimination score S1 and the music and background sound discrimination score S2 is calculated by off-line learning. The more effective a feature parameter is for distinguishing between signal types, the larger weighting factor is provided to the feature parameter.

For the speech and music discrimination score S1, many known speech signals and music signals which are prepared in advance are input as reference data functioning as the base, and feature parameters on the reference data are learned. Thus, the weighting factors are calculated. For the music and background sound discrimination score S2, many known music signals and background sound signals which are prepared in advance are input as reference data functioning as the base, and feature parameters on the reference data are learned. Thus, the weighting factors are calculated.

First, the calculation of the speech and music discrimination score S1 is described. The feature parameter set of a kth frame of reference data to be learned is expressed as vector x, and a signal section {speech, music} to which the input audio signal belongs is expressed using z as follows.

$$x^k=\{1, x_1^k, x_2^k, \ldots, x_n^k\} \quad (1)$$

$$z^k=\{-1, +1\} \quad (2)$$

Here, elements of expression (1) corresponds to n feature parameters extracted. In expression (2), −1 and +1 correspond to a speech section and a music section, respectively. Binary labeling is manually performed in advance for sections of the right answer signal type of reference data for speech and music distinguishing. Further, from the above expression (2), the following linear discriminant function is written.

$$f(x)=A_0+A_1 \cdot x_1+A_2 \cdot x_2+\ldots+A_n \cdot x_n \quad (3)$$

For k=1 to N (N is the number of input frames of reference data), vector x is extracted, a normal equation in which the evaluation value and the right answer signal type of expression (3), the sum of squared errors of expression (2), and expression (4) are minimum is solved. Thus, a weighting factor $A_i$ (i=0 to n) for each feature parameter is determined.

$$Esum=\sum_{k=1}^{N}(z^k-f(x^k))^2 \quad (4)$$

The evaluation value of an audio signal which is actually discriminated is calculated from the expression (3) using a weighting factor determined by learning. If f(x)<0, the audio signal is determined be a speech section; if f(x)>0, the audio signal is determined to be a music section. The function f(x) at this point corresponds to the speech and music discrimination score S1. Thus, S1 is calculated as follows:

$$S1=A_0+A_1 \cdot x_1+A_2 \cdot x_2+\ldots+A_n \cdot x_n$$

For calculation of the music and background sound discrimination score S2, similarly, the feature parameter set of a kth frame of reference data to be learned is expressed as vector y, and a signal section {background sound, music} to which the input audio signal belongs is expressed using z as follows.

$$y^k=\{1, y_1^k, y_2^k, \ldots, y_n^k\} \quad (5)$$

$$z^k=\{-1, +1\} \quad (6)$$

Here, elements of expression (5) corresponds to m feature parameters extracted. In expression (6), −1 and +1 correspond to a background sound section and a music section, respectively. Binary labeling is manually performed in advance for sections of the right answer signal type of reference data for music and background sound distinguishing. Further, from the above expression (6), the following linear discriminant function is written.

$$f(y)=B_0+B_1 \cdot y_1+B_2 \cdot y_2+\ldots+B_m \cdot y_m \quad (7)$$

For k=1 to N (N is the number of input frames of reference data), vector y is extracted, a normal equation in which the evaluation value and the right answer signal type of expression (7), the sum of squared errors of expression (6), and expression (8) are minimum is solved. Thus, a weighting factor $B_i$ (i=0 to m) for each feature parameter is determined.

$$Esum=\sum_{k=1}^{N}(z^k-f(y^k))^2 \quad (8)$$

The evaluation value of an audio signal which is actually discriminated is calculated from the expression (7) using a weighting factor determined by learning. If f(y)<0, the audio signal is determined to be a background sound section; if f(y)>0, the audio signal is determined to be a music section. The function f(y) at this point corresponds to the music and background sound discrimination score S2. Thus, S2 is calculated as follows:

$$S2=B_0+B_1 \cdot y_1+B_2 \cdot y_2+\ldots+B_m \cdot y_m$$

Note that calculation of the speech and music discrimination score S1 and calculation of the music and background sound discrimination score S2 are not limited to the foregoing method of multiplying a feature parameter by a weighting factor obtained by off-line learning using a linear discriminant function. For example, it is possible to use a method in which an experimental threshold is set for the calculated value of each feature parameter, each feature parameter is provided with a weighed point in accordance with comparison with the threshold, and a score is calculated.

Figure 6:
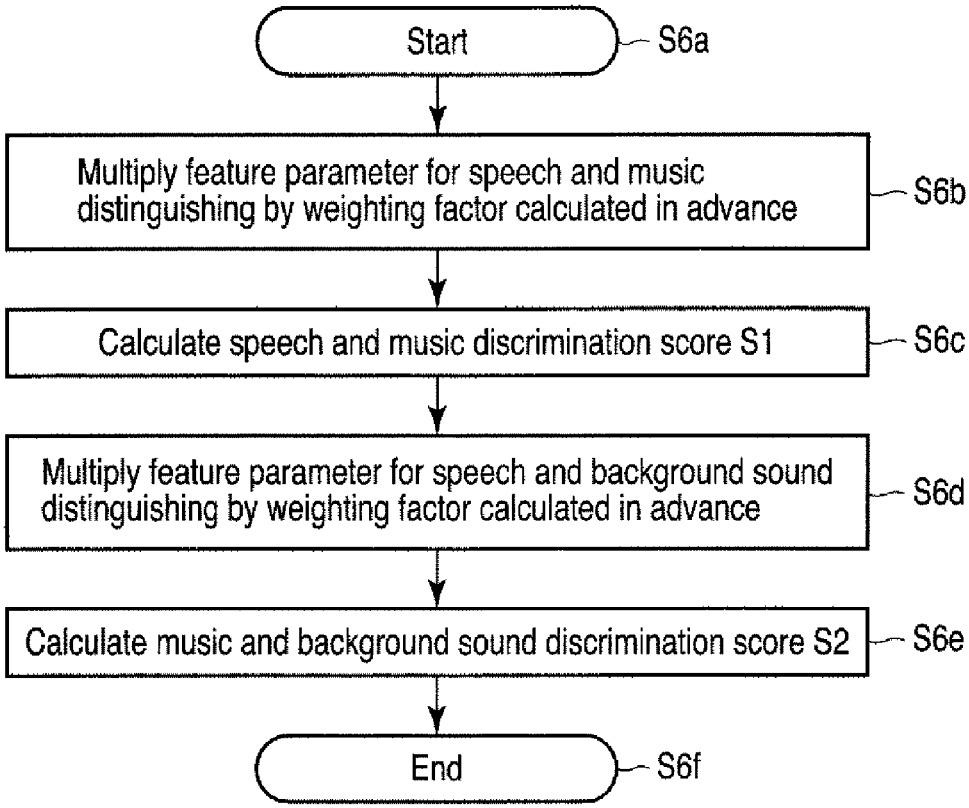
FIG. 6 is a flowchart showing the calculation operation of a speech and music discrimination score and a music and background sound discrimination score performed by the sound quality correction processing module in the embodiment.

FIG. 6 shows an example of a flowchart which works out the processing operation with which the speech and music discrimination score calculation module 82 and the music and background sound discrimination score calculation module 83 calculate the speech and music discrimination score S1 and the music and background sound discrimination score S2, based on the weighting factor of each feature parameter which is calculated in off-line learning using a linear discriminant function as mentioned above.

That is, when the process starts (step S6*a*), the speech and music discrimination score calculation module 82 provides weighting factors based on feature parameters of reference data for speech and music distinguishing learned in advance to various feature parameters calculated in the feature parameter calculation module 81, and calculates feature parameters multiplied by the weighting factors in step S6*b*. Then, the speech and music discrimination score calculation module 82 calculates the total sum of feature parameters multiplied by the weighting factors as the speech and music discrimination score S1 in step S6*c*.

The music and background sound discrimination score calculation module 83 provides weighting factors based on feature parameters of the reference data for music and background sound distinguishing learned in advance to various feature parameters calculated in the feature parameter calculation module 81, and calculates feature parameters multiplied by the weighting factors in step S6*d*. Then, the music and background sound discrimination score calculation module 83 calculates the total sum of feature parameters multiplied by the weighting factors as the music and background sound discrimination score S2 in step S6*e*, and the process ends (step S6*f*).

Description is given on a method by which the mixing control module 90 sets the gains Go, Gs and Gm to be provided to the variable gain amplifiers 84, 85 and 86 in accordance with the determination score S1' generated based on the input speech and music discrimination score S1 and the music and background sound discrimination score S2.

The determination score S1', the detailed calculation of which will be described later, quantitatively represents whether an input audio signal is close to the characteristic of a speech signal or the characteristic of a music signal in consideration of influence of a background sound. The positive score means that the music signal is strong. In contrast, the negative score means that the speech signal is strong.

Figure 7:
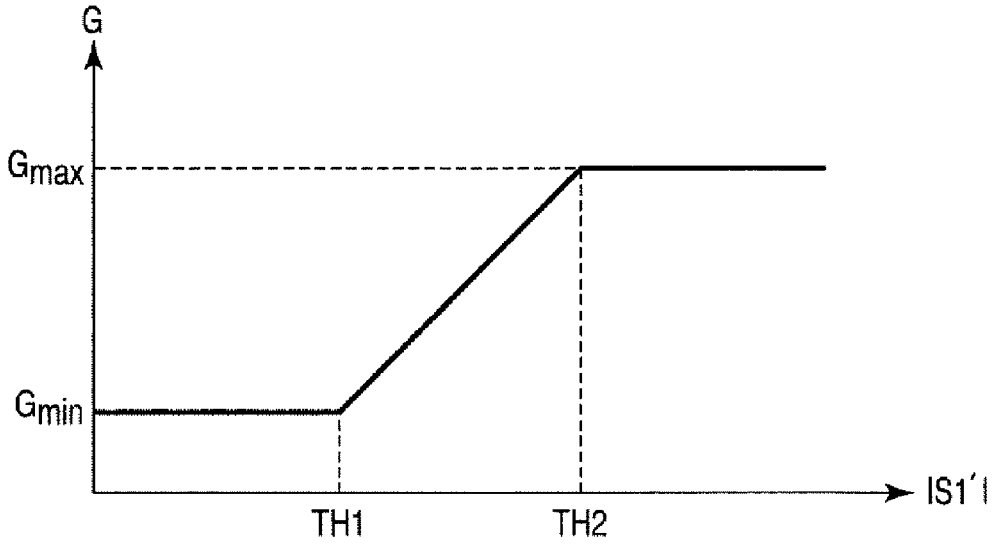
FIG. 7 is a graph showing a setting method of a gain provided to each variable gain amplifier included in the sound quality correction processing module in the embodiment.

FIG. 7 shows the relationship between the determination score S1' and the gain G (Gs or Gm). That is, when the absolute value |S1'| of the determination score S1' is smaller than a threshold value TH1 set in advance, that is, when |S1'|<TH1, the gain G is set to Gmin. When the absolute value

|S1'| the determination score S1' is a threshold value TH2 set in advance or more, that is, when |S1'|≧TH2, the gain G is set to Gmax.

Further, when the absolute value |S1'| of the determination score S1' is the threshold value TH1 or more and smaller than the threshold value TH2, that is, when TH1≦|S1'|<TH2, the gain G is as follows:

$$G=G\min+(G\max-G\min)/(TH2-TH1)\cdot(|S1'|-TH1)$$

The gain G is saturated when the absolute value |S1'| of the determination score S1' is smaller than the threshold value TH1 and when it is the threshold value TH2 or more, in order to suppress the drift of the gain G in a state where the determination of speech or music is steady.

If the determination score S1' is positive, the gain Gs which is provided to the variable gain amplifier 85 to amplify a speech signal is controlled to be 0, and the gain Gm which is provided to the variable gain amplifier 86 to amplify a music signal is determined from the characteristic shown in FIG. 7 in accordance with the determination score S1'. If the determination score S1' is negative, the gain Gm which is provided to the variable gain amplifier 86 to amplify a music signal is controlled to be 0, and the gain Gs which is provided to the variable gain amplifier 85 to amplify a speech signal is determined from the characteristic shown in FIG. 7 in accordance with the determination score S1'.

Note that the gain Go which is provided to the variable gain amplifier 84 to amplify an input audio signal (sound source signal) is set based on another gain G (Gs or Gm) such that Go=1.0−G, in order to adjust the signal power after mixing by the adder 87. Here, if the gain G (Gs or Gm) is 0, the operation of the variable gain amplifiers 85 and 86 may be stopped.

A sound source signal, a speech signal and a music signal are multiplied by the gains Go, Gs and Gm obtained as mentioned above, respectively. The resultant signals are added and supplied to the level correction module 88 for level correction.

Figure 8:
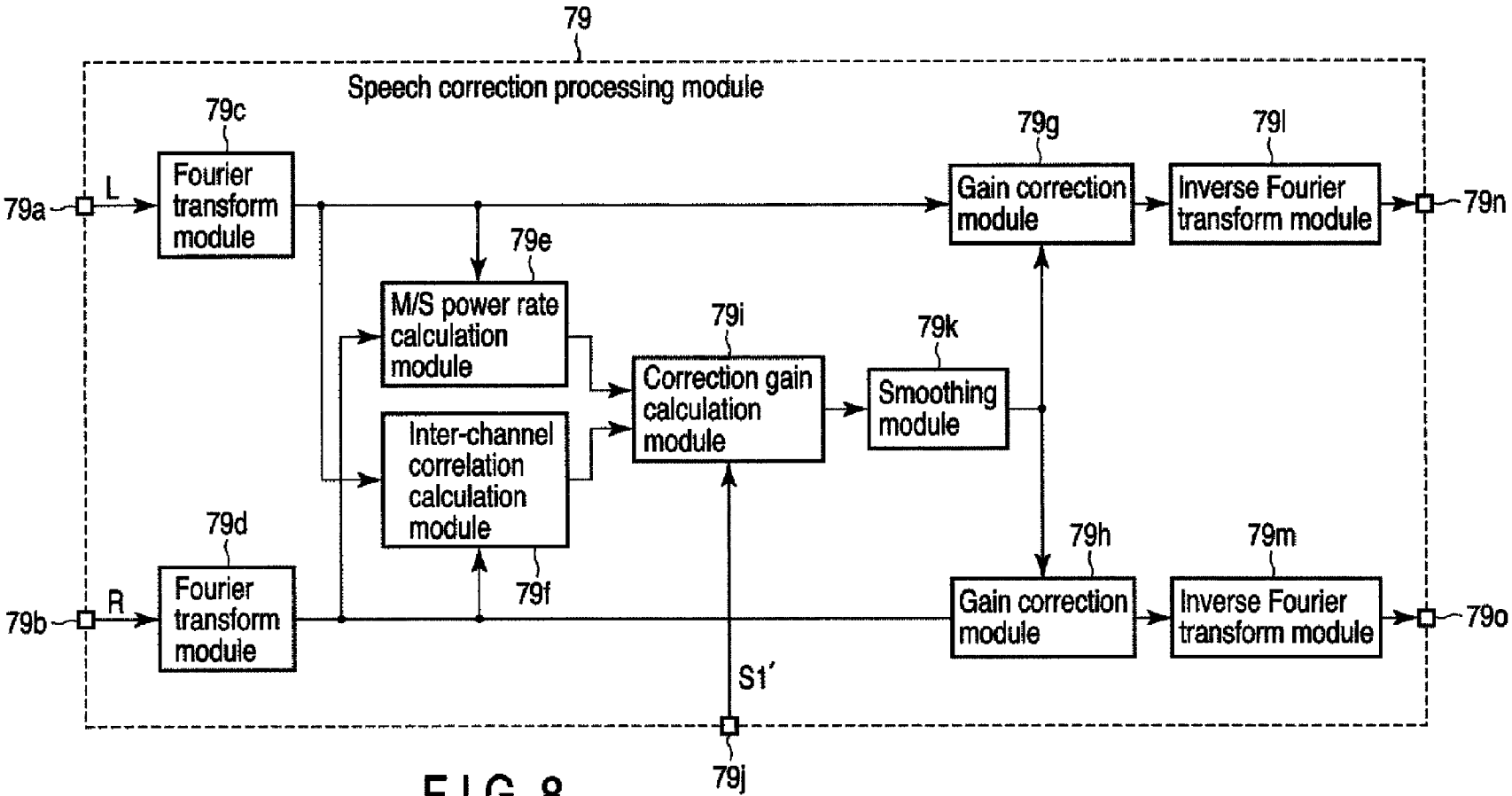
FIG. 8 is a block diagram showing a speech correction processing module included in the sound quality correction processing module in the embodiment.

FIG. 8 shows the speech correction processing module 79. The speech correction processing module 79 functions to emphasize a speech signal localized at the center as described above. That is, audio signals in left (I) and right (R) channels supplied to input terminals 79*a* and 79*b* are supplied to Fourier transform modules 79*c* and 79*d*, respectively, and are then transformed into frequency domain signals (spectra).

An L-channel audio signal component output from the Fourier transform module 79*c* is supplied to each of an M/S power rate calculation module 79*e*, an inter-channel correlation calculation module 79*f* and a gain correction module 79*g*. An R-channel audio signal component output from the Fourier transform module 79*d* is supplied to each of the M/S power rate calculation module 79*e*, the inter-channel correlation calculation module 79*f* and a gain correction module 79*h*.

Among these modules, the M/S power rate calculation module 79*e* calculates an M/S power rate (M/S) from a sum signal (M signal) and a difference signal (S signal) for every frequency bin in both channels. The purpose of calculating the M/S power rate is extracting a spectral component localized at the center. As the M/S power rate increases, the likelihood of a signal component being localized at the center increases.

The inter-channel correlation calculation module 79*f* calculates a correlation coefficient between spectra of channels for every bark band. The purpose of calculating the inter-channel correlation is that as the correlation coefficient increases (closer to 1), the likelihood of a spectral signal component being localized at the center increases, as with the case of MS power rate.

Figure 9:
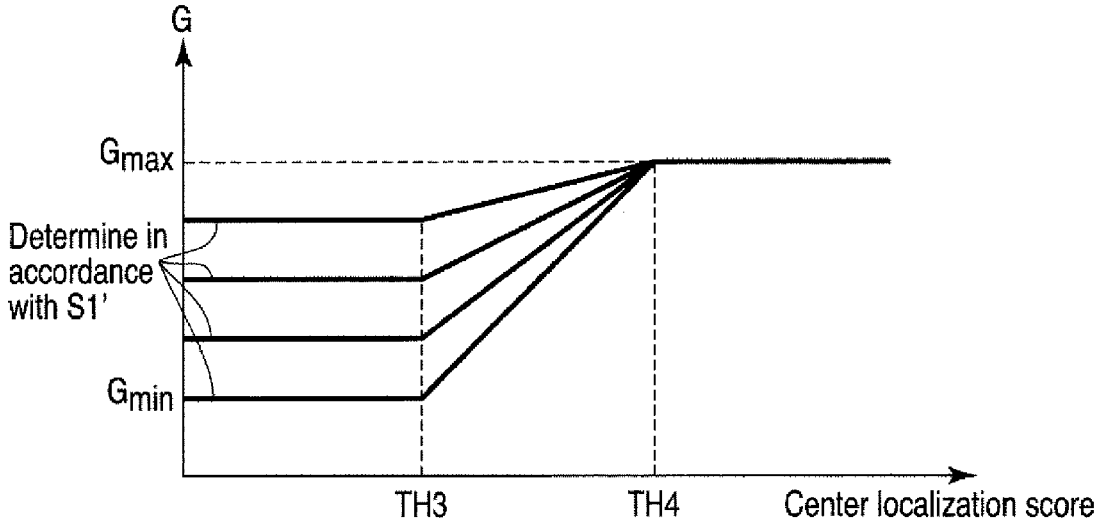
FIG. 9 is a graph showing a setting method of correction gains used in the speech correction processing module in the embodiment.

The M/S power rate calculated in the M/S power rate calculation module 79*e* and the inter-channel correlation coefficient calculated in the inter-channel correlation calculation module 79*f* are supplied to a correction gain calculation module 79*i*. In the correction gain calculation module 79*i*, the input parameters (M/S power rate and inter-channel correlation coefficient) are each weighted and added, so that a center localization score is calculated. Based on the center localization score, a correction gain for every frequency bin is obtained for emphasizing a spectral component localized at the center, in accordance with the same relationship as in FIG. 7 (however, the thresholds are TH3 and TH4 as shown in FIG. 9).

That is, the correction gain calculation module 79*i* increases the gain of a frequency component having a high center localization score, and decreases the gain having a low center localization score. The correction gain calculation module 79*i* can replace the gain control in each of the variable gain amplifiers 84 to 86 by the mixing control module 90 shown in FIG. 3, or control emphasizing effects in accordance with the characteristic score as processing in parallel to that gain control.

Specifically speaking, the correction gain calculation module 79*i* can determine the input signal as a speech signal if the determination score S1' supplied through an input terminal 79*j* is negative. Therefore, based on the determination score S1', this module controls the correction characteristic so as to increase the correction gain lower limit (or decrease the threshold TH3) as shown in FIG. 9. This facilitates emphasizing effects.

The correction gain calculated in the correction gain calculation module 79*i* is supplied to a smoothing module 79*k*. Regarding correction gains calculated in the correction gain calculation module 79*i*, if a difference in correction gain between frequency bins adjacent to each other is large, an allophone is generated. To avoid this, the smoothing module 79*k* performs smoothing for correction gains, and then supplies the gains to the gain correction modules 79*g* and 79*h*.

In the gain correction module 79*g* and 79*h*, the input L- and R-channel audio signal components are multiplied by correction gains for every frequency bin for emphasizing. The L- and R-channel audio signal components corrected in the gain correction modules 79*g* and 79*h* are supplied to inverse Fourier transform modules 79*l* and 79*m*, respectively, for the frequency domain signals to be restored to time domain signals, which are output through output terminals 79*n* and 79*o* to the variable gain amplifier 85.

Note that although emphasizing the center for a 2-channel audio signal has been described with reference to FIG. 8, the same processing can be performed by emphasizing the center channel in the case of a multichannel audio signal.

Figure 10:
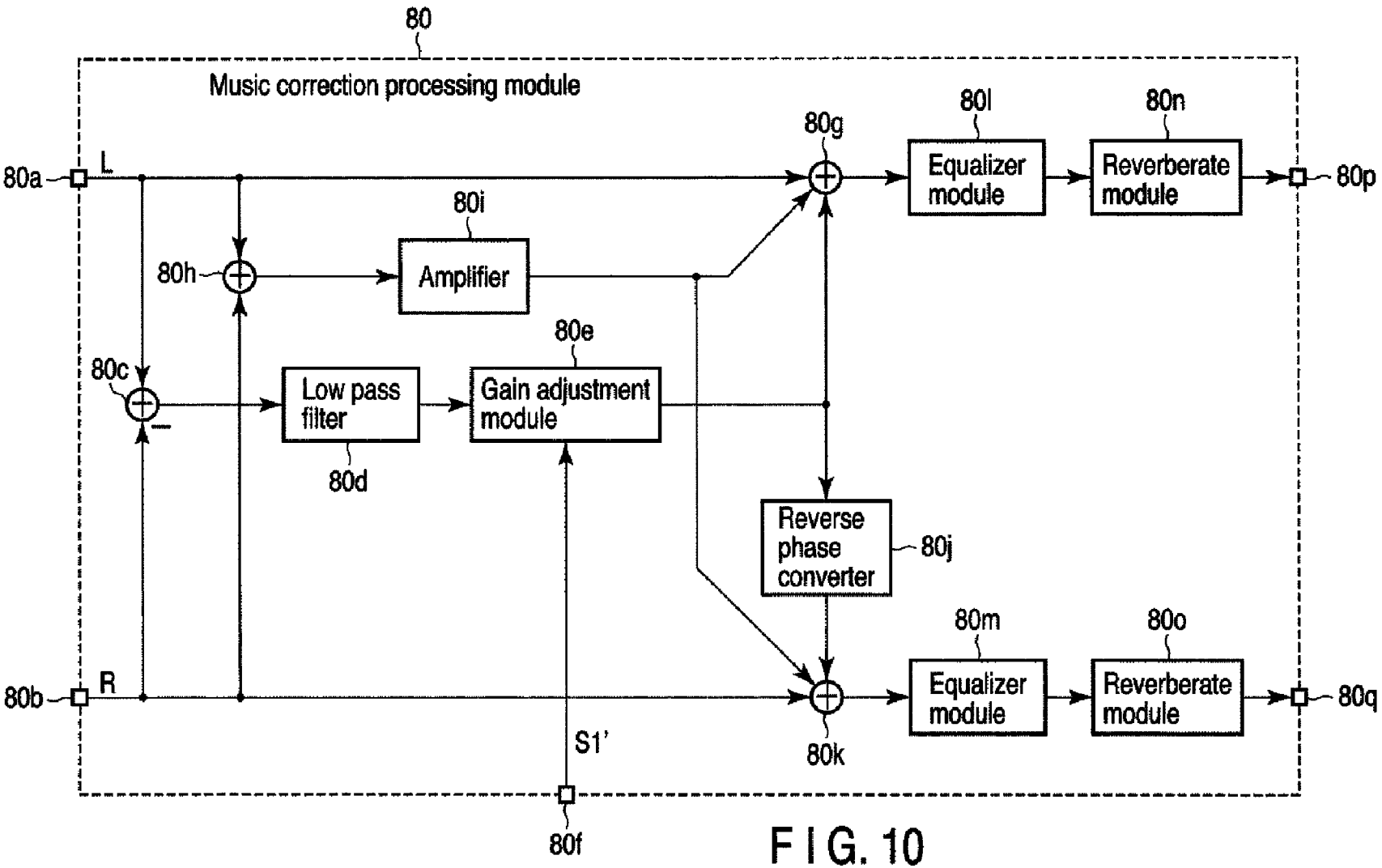
FIG. 10 is a block diagram showing a music correction processing module included in the sound quality correction processing module in the embodiment.

FIG. 10 shows the music correction processing module 80. The music correction processing module 80 functions to accomplish a sound field with spreading feeling by performing a wide stereo process or a reverberate process to a music signal, as described above. That is, audio signals in left (L) and right (R) channels supplied to input terminals 80*a* and 80*b* are supplied to a subtractor 80*c* to obtain their difference in order to emphasize stereo teeing (make spreading feeling).

The difference is further passed through a low pass filter 80*d* with a cut-off frequency of about 1 kHz in order to improve the audibility characteristic, and then is supplied to a gain adjustment module 80*e*, where gain adjustment is performed based on the determination score S1' supplied through an input terminal 80*f*. The signal after gain adjustment, an L-channel audio signal supplied to the input terminal 80*a*, and a signal obtained by adding up L- and R-channel audio signals supplied to the input terminals 80*a* and 80*b* by an adder 80*h* and amplifying the resultant signal by an amplifier 80*i* are added up by an adder 80*g*.

The signal for which gain adjustment is performed in the gain adjustment module 80*e* is converted so that its phase is reversed in a reverse phase converter 80*j*, and then is added together with an R-channel audio signal supplied to the input terminal 80*b* and an output signal of the amplifier 80*i* by an adder 80*k*. In this way, a difference between L and R channels can be emphasized by reversing the phase of the audio signal and adding the signal in the L channel and the R channel.

The gain adjustment module 80*e* can replace the gain control in each of the variable gain amplifiers 84 to 86 by the mixing control module 90 shown in FIG. 3, or control emphasizing effects in accordance with the characteristic score as processing in parallel to that gain control. Specifically speaking, the gain adjustment module 80*e* can determine the input signal as a music signal if the determination score S1' is positive. Therefore, in accordance with |S1'|, this module controls the gain of a difference signal obtained from the subtractor 80*c* (that is, increasing the gain as |S1'| increases) as the characteristic shown in FIG. 7. This facilitates correction effects.

To compensate the decrease of a center component associated with emphasis on a difference signal, a signal obtained by performing gain adjustment (attenuation) in the amplifier 80*i* for the sum signal which is obtained by adding audio signals in the L and R channels by the adder 80*h* is added in each of the adders 80*g* and 80*k*.

The output signals of the adders 80*g* and 80*k* are supplied to equalizer modules 80*l* and 80*m*, respectively. The equalizer modules 80*l* and 80*m* perform gain adjustment of the whole in terms of improvement in audibility characteristic for stereo signals, for the sake of emphasizing a higher range so as to compensate the relative drop of the higher range caused by passing a difference signal through the low pass filter 80*d*, and for the sake of suppressing uncomfortable feeling due to power variations before and after correction.

Then, the output signals of the equalizer modules 80*l* and 80*m* are supplied to reverberate modules 80*n* and 80*o*, respectively. The reverberate modules 80*n* and 80*o* convolve the impulse response having a delay characteristic imitating reverberation of the reproduction environment (room and the like), and generates correction sound to provide a sound field effect having spreading feeling, which is suitable for listening music. The output signals of the reverberate modules 80*n* and 80*o* are output through output terminals 80*p* and 80*q* to the variable gain amplifier 86.

Figure 11:
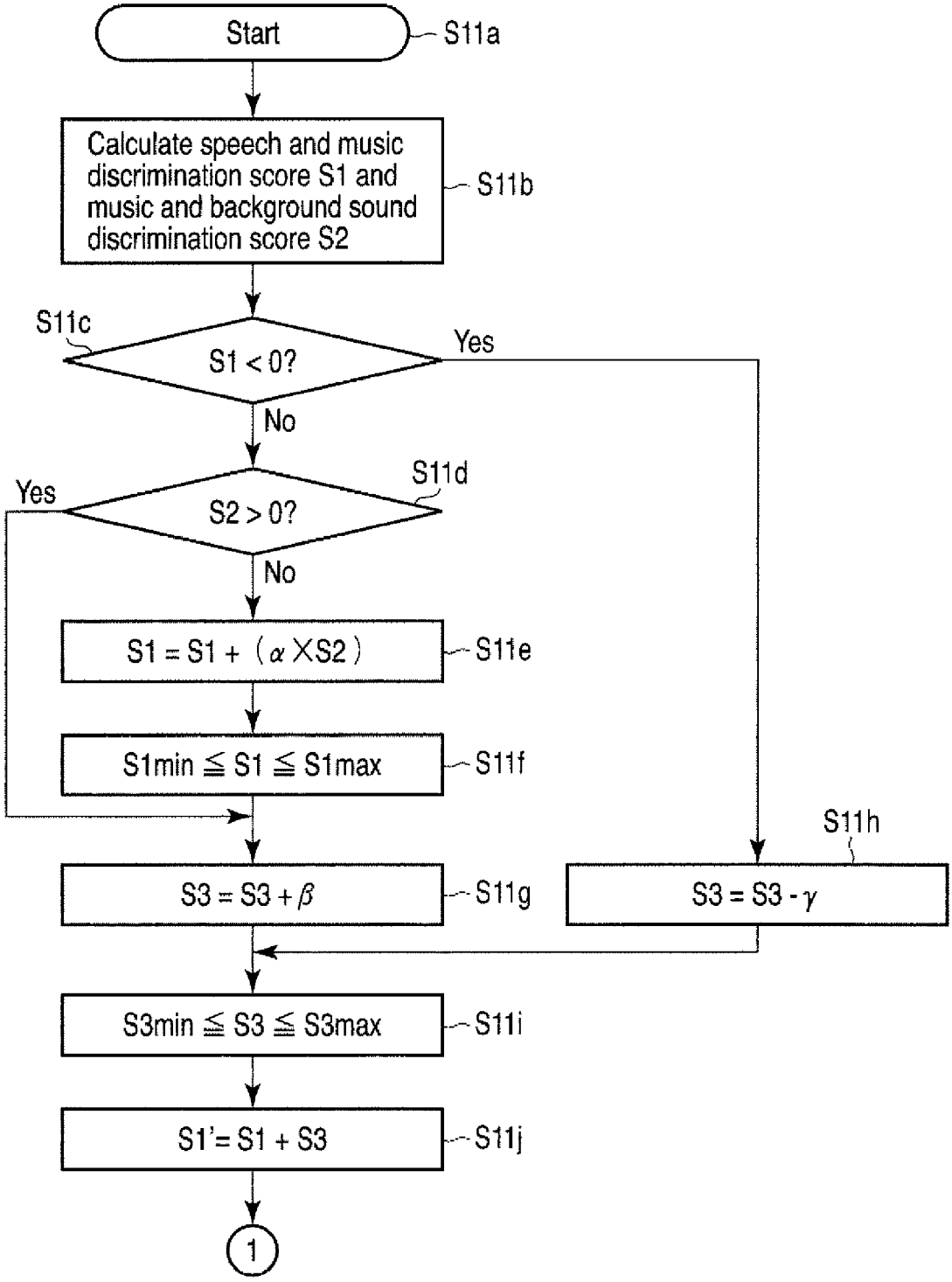
FIG. 11 is a flowchart showing part of the operation performed by the sound quality correction processing module in the embodiment.
Figure 12:
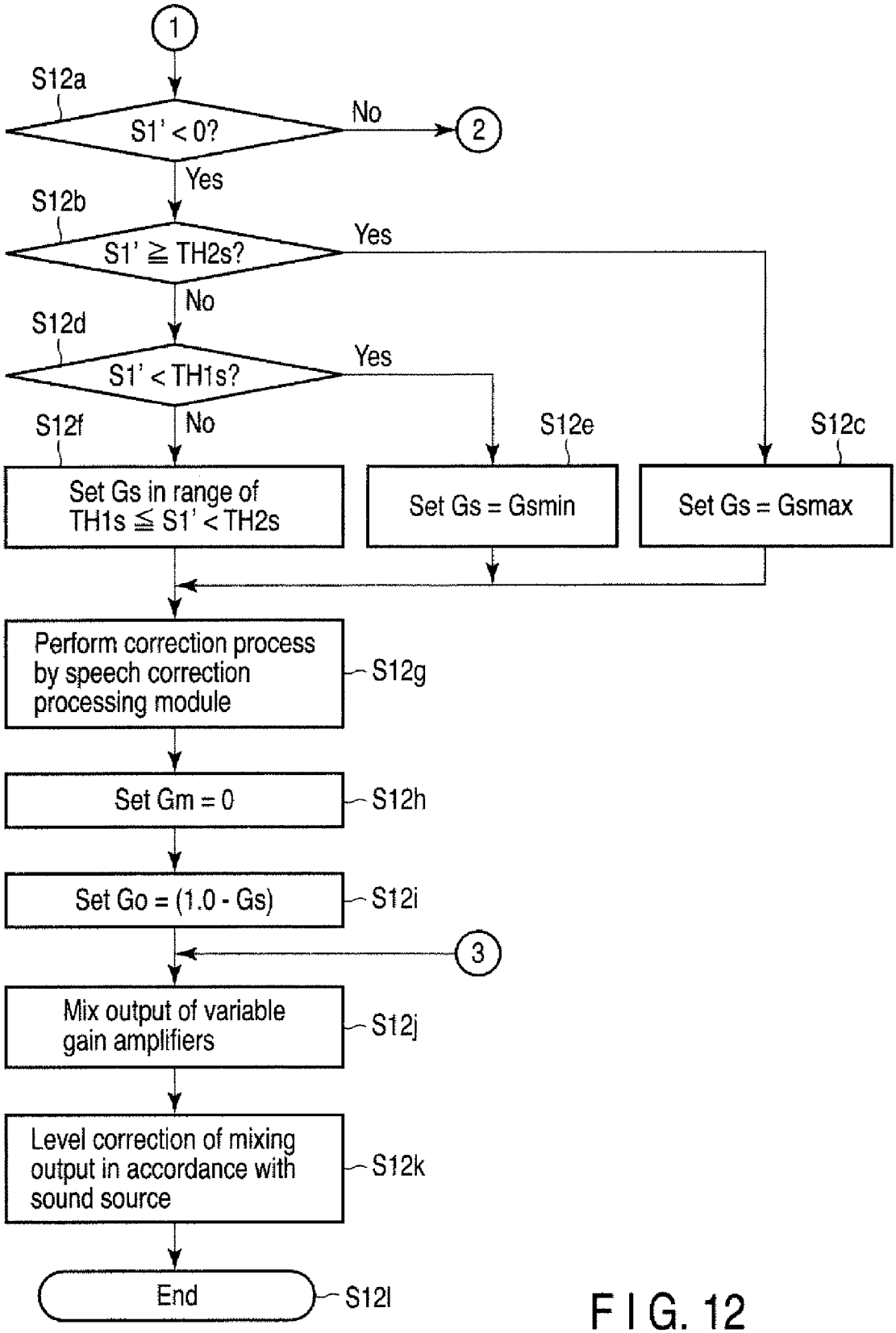
FIG. 12 is a flowchart showing another part of the operation performed by the sound quality correction processing module in the embodiment.
Figure 13:
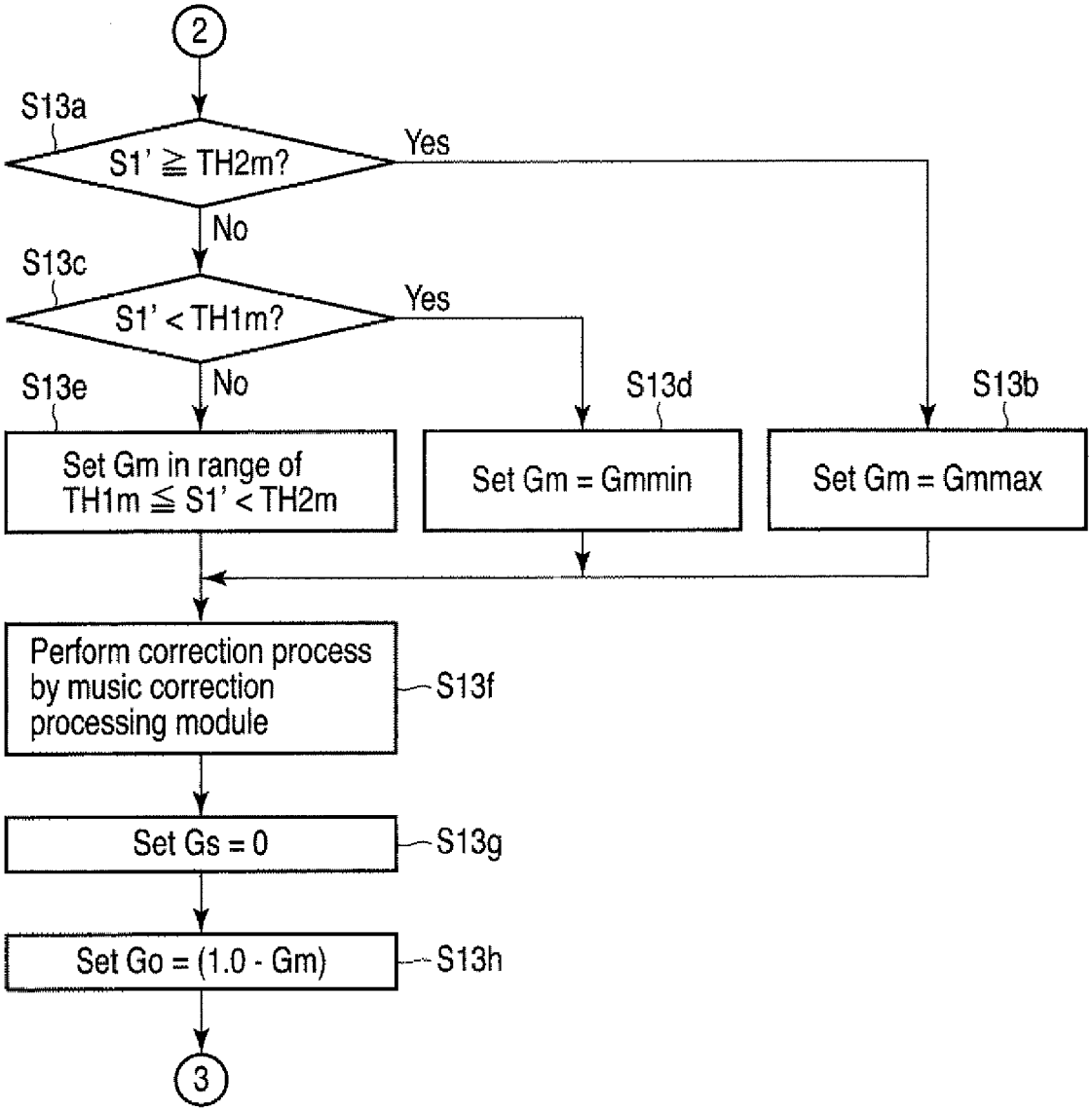
FIG. 13 is a flowchart showing the remainder of the operation performed by the sound quality correction processing module in the embodiment.

FIGS. 11 to 13 show flowcharts which work out a series of sound quality correction processing operation performed by the sound quality correction processing module 76. That is, when the process starts (step S11*a*), the sound quality correction processing module 76 causes the speech and music discrimination score calculation module 82 and the music and background sound discrimination score calculation module 83 to calculate the speech and music discrimination score S1 and the music and background sound discrimination score 52 in step S11*b*, and determines whether the speech and music discrimination score S1 is negative (S1<0) or not, that is, whether the input audio signal is a speech or not in step S11*c*.

Then, if the speech and music discrimination score S1 is positive (S1>0), that is, if the input audio signal is determined to be music (NO), the sound quality correction processing module 76 determines whether the music and background sound discrimination score S2 is positive (S2>0) or not, that is, whether the input audio signal is music or not, in step S11*d*.

As a result, if the music and background sound discrimination score S2 is negative (S2<0), that is, if the input audio signal is determined to be background sound (NO), the sound quality correction processing module 76 corrects the speech and music discrimination score SI so as to mitigate uncomfortable feeling caused by performing a music sound quality correction process for background sound in the music correction processing module 80.

In this correction, first in step S11*e*, a value obtained by multiplying the music and background sound discrimination score S2 by a predetermined factor $\alpha$ is added to the speech and music discrimination score S1 so as to reduce a portion corresponding to contribution for background sound from the speech and music discrimination score S1. That is, S1=S1+($\alpha$×S2). In this case, since the music and background sound discrimination score S2 is negative, the addition results in the decreased value of the speech and music discrimination score S1.

Then, to prevent the speech and music discrimination score S1 from excessive correction in step S11*e*, a clip process is performed in step S11*f* so that the speech and music discrimination score S1 obtained in step S11*e* is settled within a range of the minimum value S1min to the maximum vale S1max, that is, S1min≦S1≦S1max.

After this step S11*f*, or if the music and background sound discrimination score S2 is determined to be positive (S2>0), that is, the input audio signal is music (YES) in step S11*d* mentioned above, the sound quality correction processing module 76 generates a stabilizing parameter S3 for enhancing the effect of the music sound quality correction process in the music correction processing module 80 in step S11*g*.

In this case, the stabilizing parameter S3 acts on the speech and music discrimination score S1, which determines the intensity of a correction process for the music correction processing module 80 in the latter part, to enhance and stabilize the correction intensity. This prevents a music signal from not obtaining a sufficient sound quality effect in the case where the speech and music discrimination score S1 does not become large, which may occur depending on a music scene.

That is, in step S11*g*, the stabilizing parameter S3 is generated by performing cumulative addition of a predetermined value $\beta$ set in advance every time a frame for which the speech and music discrimination score S1 is determined to be positive is detected Cm times or more continuously, where Cm is set in advance, so that the sound quality correction process is enhanced as the continuing time during which the generated speech and music discrimination score S1 is positive, that is, the input audio signal is determined to be a music signal is longer.

The value of the stabilizing parameter S3 is kept across frames, and is updated continuously even if the input audio signal is changed to a speech. That is, if the speech and music discrimination score S1 is negative (S1<0), that is, if the input audio signal is determined to be a speech (YES) in step S11*c*, the sound quality correction processing module 76 subtracts a predetermined value Y set in advance from the stabilizing parameter S3 every time a frame for which the speech and music discrimination score S1 is determined to be negative is detected Cs times or more continuously, where Cs is set in advance, so that the effect of the music sound quality correction process in the music correction processing module 80 is reduced as the continuing time during which the generated speech and music discrimination score S1 is negative, that is, the input audio signal is determined to be a speech signal in steps S11*h* is longer.

Then, to prevent excessive correction by the stabilizing parameter S3 generated in steps S11*g* and S11*h*, the sound quality correction processing module 76 performs a clip process in step S11*i* so that the stabilizing parameter S3 set in advance is settled within a range of the minimum value S3min to the maximum vale S3max, that is, S3min≦S3≦S3max.

The sound quality correction processing module 76 adds the stabilizing parameter S3, for which the clip process has been performed in step S11*i*, to the speech and music discrimination score S1, for which the clip process has been performed in step S11*f*, thereby generating the determination score S1' in step S11*j*.

Then, the sound quality correction processing module 76 determines whether the determination score S1' is negative (S1'<0) or not, that is, whether the input audio signal is a speech or not in step S12*a*. If the score S1' is determined to be negative (speech) (YES), the sound quality correction processing module 76 determines in step S12*b* whether or not the determination score S1' is equal to or greater than an upper limit threshold TH2*s* for a speech signal, which is set in advance, that is, whether S1'≧TH2*s* or not.

If it is determined that S1'≧TH2*s* (YES), the sound quality correction processing module 76 sets the output gain Gs for correction for a speech signal (the gain to be provided to the variable gain amplifier 85) to Gsmax in step S12*c*.

If it is determined that S1'≧TH2*s* is not satisfied (NO) in step S12*b*, the sound quality correction processing module 76 determines whether the determination score S1' is smaller than a lower limit threshold TH1*s* for a speech signal set in advance or not, that is, S1'<TH1*s*, in step S12*d*. If it is determined that S1'<TH1*s* (YES), the sound quality correction processing module 76 sets the output gain Gs for correction for a speech signal (the gain to be provided to the variable gain amplifier 85) to Gsmin in step S12*e*.

Further, if it is determined that S1'<TH1*s* is not satisfied (NO) in step S12*d*, the sound quality correction processing module 76 sets the output gain Gs for correction for a speech signal (the gain to be provided to the variable gain amplifier 85) based on a range of TH1*s*≦S1'<TH2*s* of the characteristic shown in FIG. 7 in step S12*f*.

After step S12*d*, S12*e* or S12*f*, the sound quality correction processing module 76 performs a sound quality correction process for a speech signal by the speech correction processing module 79 using the determination score S1' in step S12*g*. Then, the sound quality correction processing module 76 sets the output gain Gm for correction for a music signal (the gain to be provided to the variable gain amplifier 86) to 0 in step S12*h*.

The sound quality correction processing module 76 calculates the output gain Go for correction for a sound source signal (the gain to be provided to the variable gain amplifier 84) by an operation of 1.0−Gs in step S12*i*. Then, the sound quality correction processing module 76 mixes the output of the variable gain amplifiers 84 to 86 by the adder 87 in step S12*j*.

The sound quality correction processing module 76 performs a level correction process by the level correction module 88 based on the level of a sound source signal for the audio signal mixed by the adder 87 in step S12*k*, and the process ends (step S12*l*).

On the other hand, if the determination score S1' is positive, that is, the input audio signal is determined to be music (NO), in step S12*a*, the sound quality correction processing module 76 determines whether the determination score S1' is equal to or greater than an upper limit threshold TH2*m* for a music signal set in advance, that is, whether S1'≧TH2*m* or not, in step S13*a*. If it is determined that S1'≧TH2*m* (YES), the sound quality correction processing module 76 sets the output gain Gm for correction for a music signal (the gain to be provided to the variable gain amplifier 86) to Gmmax in step S13*b*.

If it is determined that S1'≧TH2*m* is not satisfied (NO) in step S13*a*, the sound quality correction processing module 76 determines whether the determination score S1' is smaller than a lower limit threshold TH1*m* for a music signal set in advance, that is, whether S1'<TH1*m* or not, in step S13*c*. If it is determined that S1'<TH1*m* (YES), the sound quality correction processing module 76 sets the output gain Gm for correction for a music signal (the gain to be provided to the variable gain amplifier 86) to Gmmin in step S13*d*.

Further, if it is determined that S1'<TH1*m* is not satisfied (NO) in step S13*c*, the sound quality correction processing module 76 sets the output gain Gm for correction for a music signal (the gain to be provided to the variable gain amplifier 86) based on a range of TH1*m*≦S1'<TH2*m* of the characteristic shown in FIG. 7, in step S13*e*.

After step S13*b*, S13*d* or S13*e*, the sound quality correction processing module 76 performs a sound quality correction process for a music signal by the music correction processing module 80 using the determination score S1' in step S13*f*. Then, the sound quality correction processing module 76 sets the output gain Gs for correction for a speech signal (the gain to be provided to the variable gain amplifier 85) to 0 in S13*g*.

The sound quality correction processing module 76 calculates the output gain Go for correction for a sound source signal (the gain to be provided to the variable gain amplifier 84) by an operation of 1.0−Gm in step S13*h*, and proceeds to the process in step S12*j*.

Figure 14:
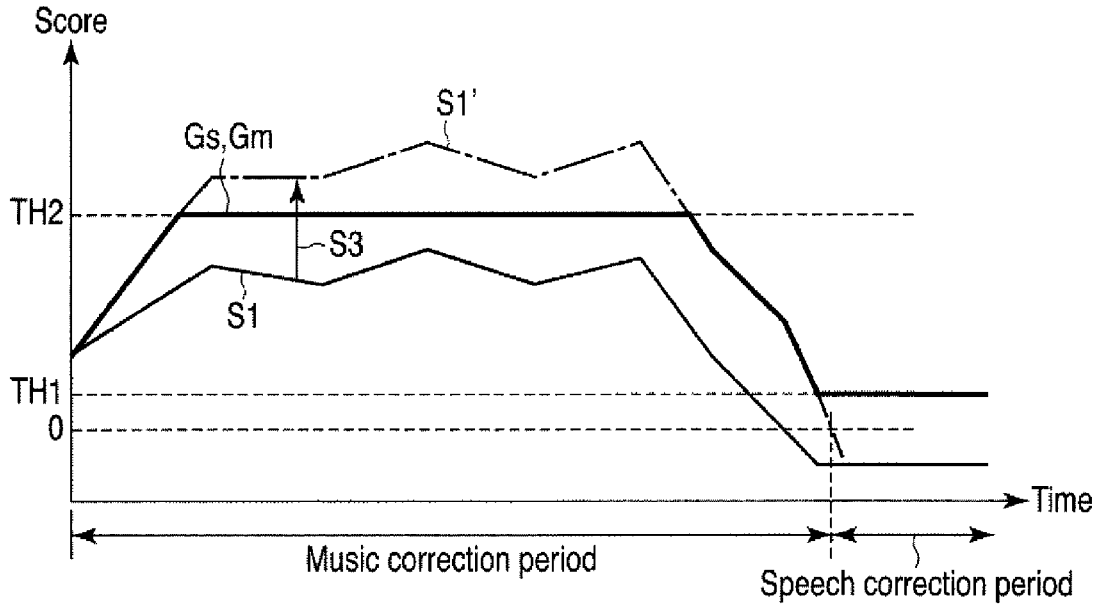
FIG. 14 shows score correction performed by the sound quality correction processing module in the embodiment.

FIG. 14 explains the processing operation to correct the speech and music discrimination score S1 with the stabilizing parameter S3. That is, if the speech and music discrimination score S1, which is the original, is positive, that is, the input audio signal is determined to be a music signal, the speech and music discrimination score S1 is raised with the stabilizing parameter S3 so as to strengthen the sound quality correction process for a music signal as time elapses. Thus, the determination score S1' is generated.

In this case, while the speech and music discrimination score S1, which is the original, transits in a value equal to or less than the upper limit threshold TH2 of the characteristic shown in FIG. 7, the determination score S1' is kept to a value equal to or greater than the upper limit threshold TH2. However, considering that the sound quality correction intensity for a music signal is saturated with the gain Gmax corresponding to the upper limit threshold TH2, a stable sound quality correction processing can actually be achieved with the gain transition indicated by a thick line in FIG. 14.

If the speech and music discrimination score S1, which is the original, is negative, that is, the input audio signal is determined to be a speech signal, the stabilizing parameter S3 is controlled to be decreased, so that the sound quality correction process for a music signal is reduced as time elapses, swiftly switching to a sound quality correction process for a speech signal.

According to the above embodiment, feature quantities of a speech and music are each analyzed from an input audio signal, and it is determined from the feature parameters using scores whether the input audio signal is close to a speech signal or close to a music signal. If the input audio signal is determined to be music, the preceding score determination result is corrected considering the effect of background sound. Based on the score value, the sound quality correction process is performed. A robust and stable sound quality correction function can thus be achieved for background sound.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sound quality correction apparatus comprising:

a feature parameter calculator configured to calculate various feature parameters for distinguishing between a speech signal and a music signal and distinguishing between the music signal and a background sound signal, for an input audio signal;

a speech and music discrimination score calculator configured to calculate a speech and music discrimination score indicating which of the speech signal and the music signal the input audio signal is close to, based on the various feature parameters for distinguishing between the speech signal and the music signal calculated in the feature parameter calculator;

a music and background sound discrimination score calculator configured to calculate a music and background sound discrimination score indicating which of the music signal and the background sound signal the input audio signal is close to, based on the various feature parameters for distinguishing between the music signal and the background sound signal calculated in the feature parameter calculator;

a speech and music discrimination score corrector configured to correct the speech and music discrimination score based on a value of the music and background sound discrimination score when the speech and music discrimination score calculated in the speech and music discrimination score calculator indicates the music signal and when the music and background sound discrimination score calculated in the music and background sound discrimination score calculator indicates the background sound signal; and a sound quality corrector configured to determine closeness to the speech signal or the music signal of the input audio signal based on the speech and music discrimination score corrected in the speech and music discrimination score corrector and perform a sound quality correction process for the speech or the music.

2. The sound quality correction apparatus of claim 1, wherein the speech and music discrimination score corrector is configured to multiply the music and background sound discrimination score calculated in the music and background sound discrimination score calculator by a predetermined factor and add the music and background sound discrimination score multiplied by the factor to the speech and music discrimination score calculated in the speech and music discrimination score calculator to thereby correct the speech and music discrimination score.

3. The sound quality correction apparatus of claim 1, wherein the speech and music discrimination score calculator is configured to multiply each of various feature parameters for distinguishing between the speech signal and the music signal calculated in the feature parameter calculator by a weighting factor, the weighting factor being calculated by learning each feature parameter by using a speech signal and a music signal prepared in advance as reference data, and calculate a total sum of each feature parameter multiplied by the weighting factor as the speech and music discrimination score, and the music and background sound discrimination score calculator is configured to multiply each of various feature parameters for distinguishing between the music signal and the background sound signal calculated in the feature parameter calculator by a weighting factor, the weighting factor bring calculated by learning each feature parameter by using a music signal and a background sound signal prepared in advance as reference data, and calculate a total sum of each feature parameter multiplied by the weighting factor as the music and background sound discrimination score.

4. The sound quality correction apparatus of claim 1, wherein the speech and music discrimination score calculator is configured to divide the input audio signal by a predetermined unit and calculate a speech and music discrimination score by the unit after dividing.

5. The sound quality correction apparatus of claim 4, further comprising a stabilizing parameter adder configured to add a stabilizing parameter to the speech and music discrimination score for the sound quality corrector to increase a correction intensity for music, when the speech and music discrimination score calculated by the predetermined unit of the input audio signal in the speech and music discrimination score calculator indicates a music signal a predetermined number of times or more continuously, and to add a stabilizing parameter to the speech and music discrimination score for the sound quality corrector to reduce correction for music, when the speech and music discrimination score calculated by the predetermined unit of the input audio signal in the speech and music discrimination score calculator indicates a speech signal a predetermined number of times or more continuously.

6. The sound quality correction apparatus of claim 1, further comprising a level corrector configured to apply a level correction process to the audio signal to which a sound quality correction process is applied by the sound quality corrector so that a level variation with the input audio signal is settled within a predetermined range.

7. A sound quality correction method of adaptively applying a sound quality correction process to a speech signal and a music signal included in an input audio signal by using a sound quality correction apparatus, the method comprising:

calculating by a feature parameter calculation module included in the sound quality correction apparatus various feature parameters for distinguishing between the speech signal and the music signal and distinguishing between the music signal and a background sound signal, for the input audio signal;

calculating by a speech and music discrimination score calculation module included in the sound quality correction apparatus a speech and music discrimination score indicating which of the speech signal and the music signal the input audio signal is close to, based on the various feature parameters for distinguishing between the speech signal and the music signal calculated by the feature parameter calculation module;

calculating by a music and background sound discrimination score calculation module included in the sound quality correction apparatus a music and background sound discrimination score indicating which of the music signal and the background sound signal the input audio signal is close to, based on the various feature parameters for distinguishing between the music signal and the background sound signal calculated by the feature parameter calculation module;

correcting by a speech and music discrimination score correction module included in the sound quality correction apparatus the speech and music discrimination score based on a value of the music and background sound discrimination score when the speech and music discrimination score calculated by the speech and music discrimination score calculation module indicates the music signal and when the music and background sound discrimination score calculated by the music and background sound discrimination score calculation module indicates the background sound signal; and determining by a sound quality correction module included in the sound quality correction apparatus closeness to the speech signal or the music signal of the input audio signal based on the speech and music discrimination score corrected by the speech and music discrimination score correction module and performing a sound quality correction process for a speech or music.

8. A non-transitory computer readable medium having stored thereon a computer program which is executable by a computer, the computer program controls the computer to execute functions of:

calculating various feature parameters for distinguishing between a speech signal and a music signal and distinguishing between the music signal and a background sound signal, for an input audio signal;

calculating a speech and music discrimination score indicating which of the speech signal and the music signal the input audio signal is close to, based on the various feature parameters for distinguishing between the speech signal and the music signal;

calculating a music and background sound discrimination score indicating which of the music signal and the background sound signal the input audio signal is close to, based on the various feature parameters for distinguishing between the music signal and the background sound signal;

correcting the speech and music discrimination score based on a value of the music and background sound discrimination score when the speech and music discrimination score indicates the music signal and when the music and background sound discrimination score indicates the background sound signal; and determining closeness to the speech signal or the music signal of the input audio signal based on the corrected speech and music discrimination score and performing a sound quality correction process for a speech or music.

* * * * *